US006390425B1

(12) United States Patent
Juang

(10) Patent No.: US 6,390,425 B1
(45) Date of Patent: May 21, 2002

(54) MICRO-ADJUSTING DEVICE FOR LIFTING AND LOWERING THE WORKTABLE OF A PLANER

(76) Inventor: Boy Yann Juang, No. 78, Yungfeng Rd., Taiping Shiang, Taichung (TW), 411

( * ) Notice: Subject to any disclaimer, the term of this patent is extended or adjusted under 35 U.S.C. 154(b) by 0 days.

(21) Appl. No.: 09/637,783

(22) Filed: Aug. 11, 2000

(51) Int. Cl.[7] ..... B27C 1/00

(52) U.S. Cl. ..... 248/188.2; 144/117.2; 144/129

(58) Field of Search ..... 108/145, 147; 144/117.2, 129; 248/188.2

(56) References Cited

U.S. PATENT DOCUMENTS 5,143,128 A * 9/1992 Chen ..... 144/117.2

5,979,521 A * 11/1999 Garcia ..... 144/129

* cited by examiner

*Primary Examiner*—Alvin Chin-Shue

(74) *Attorney, Agent, or Firm*—Troxell Law Office PLLC

(57) ABSTRACT

A micro adjusting device for lifting and lowering the worktable of a planer includes a base, a movable worktable positioned at one side of the base and having two fix holes in two side plates, and a micro-adjusting device positioned at one side of a connect rod of a connect rod device. The micro-adjusting device has a fix shaft pivotally connected to an upper portion. The fix shaft passes through the two fix holes of the movable worktable, enabling the worktable move up and down on the inclined surface of the base by means of the micro-adjusting device.

3 Claims, 6 Drawing Sheets

MICRO-ADJUSTING DEVICE FOR LIFTING AND LOWERING THE WORKTABLE OF A PLANER

BACKGROUND OF THE INVENTION

This invention relates to a micro-adjusting device for lifting and lowering the worktable of a planer, particularly to one convenient to operate, and simple in its structure.

A worktable lifting and lowering device of a conventional planer shown in FIG. 1, mainly includes an upper bracket 2 fixed on an inclined base 1 and having a center hole 7, a worktable 3 provided on the inclined base, a lower bracket 4 fixed with a bottom side of the worktable 3 and having a center threaded hole 8 screwing with an operating rod 5, and a hand wheel 6 screwing with the operating rod 5 after passing through the hole 7 of the upper bracket 2. When the hand wheel 6 is rotated, the operating rod 5 moves in the lower bracket 4 so as to move the worktable 3 up and down on the inclined base 1.

However, the operating rod 5 in the conventional planer moves with rotation of the threads, impossible to move quickly or to be micro-adjusted to move up and down, and very far from ideal operation of the planer.

SUMMARY OF THE INVENTION

This invention has been devised to offer a micro-adjusting device for lifting and lowering the worktable of a planer, which includes a base, a movable worktable positioned at one side of the base and having two fix holes in two side plates, a micro-adjusting device positioned at one side of a connect rod of a connect rod device. The micro-adjusting device has a fix shaft pivotally connected to an upper portion and then passing through the two fix holes of the movable worktable, enabling the movable worktable move up and down on the inclined surface of the base by means of the micro-adjusting device.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
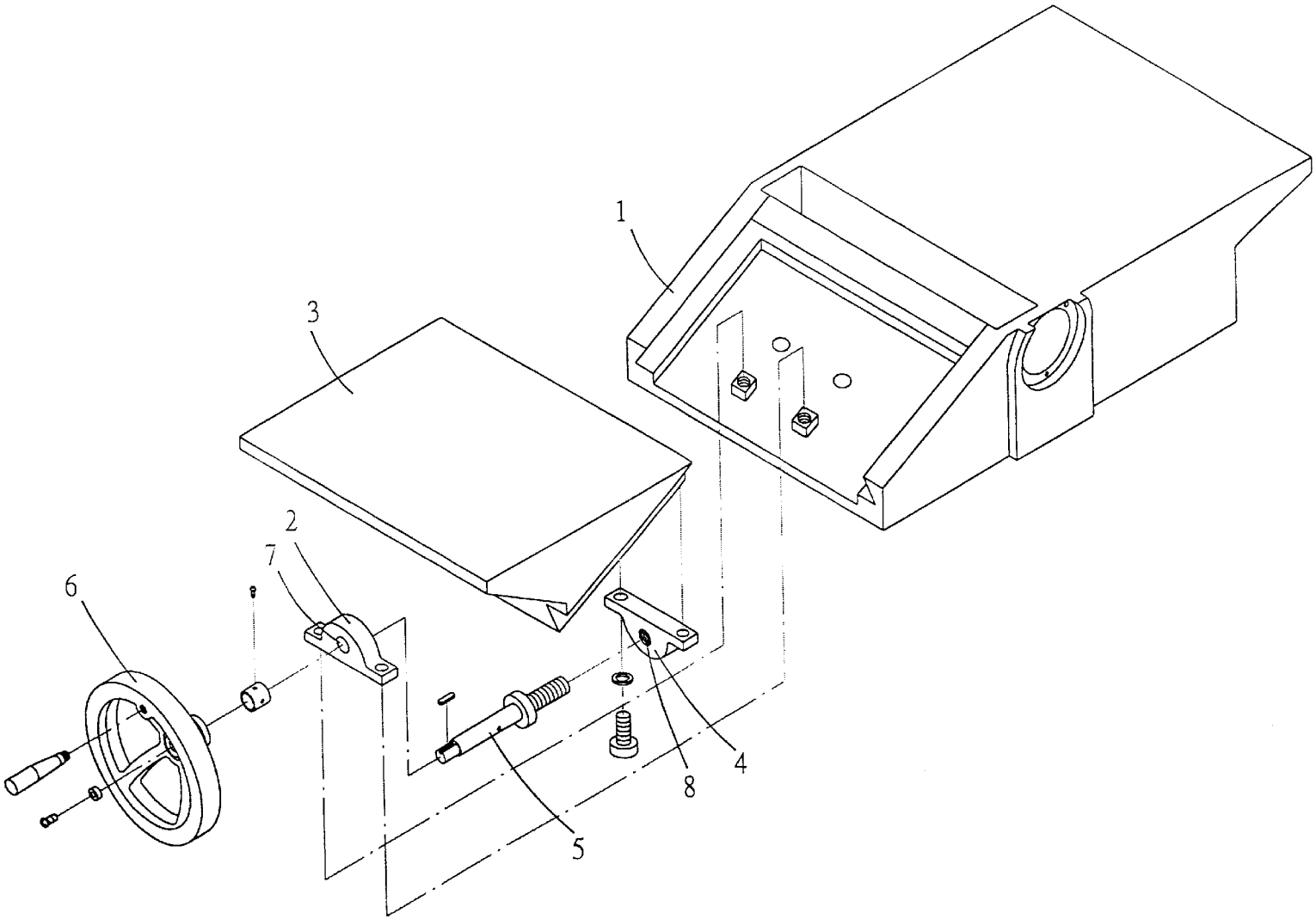
FIG. 1 PRIOR ART
FIG. 1 is an exploded perspective view of a worktable lifting and lowering device of a conventional planer.
Figure 2:
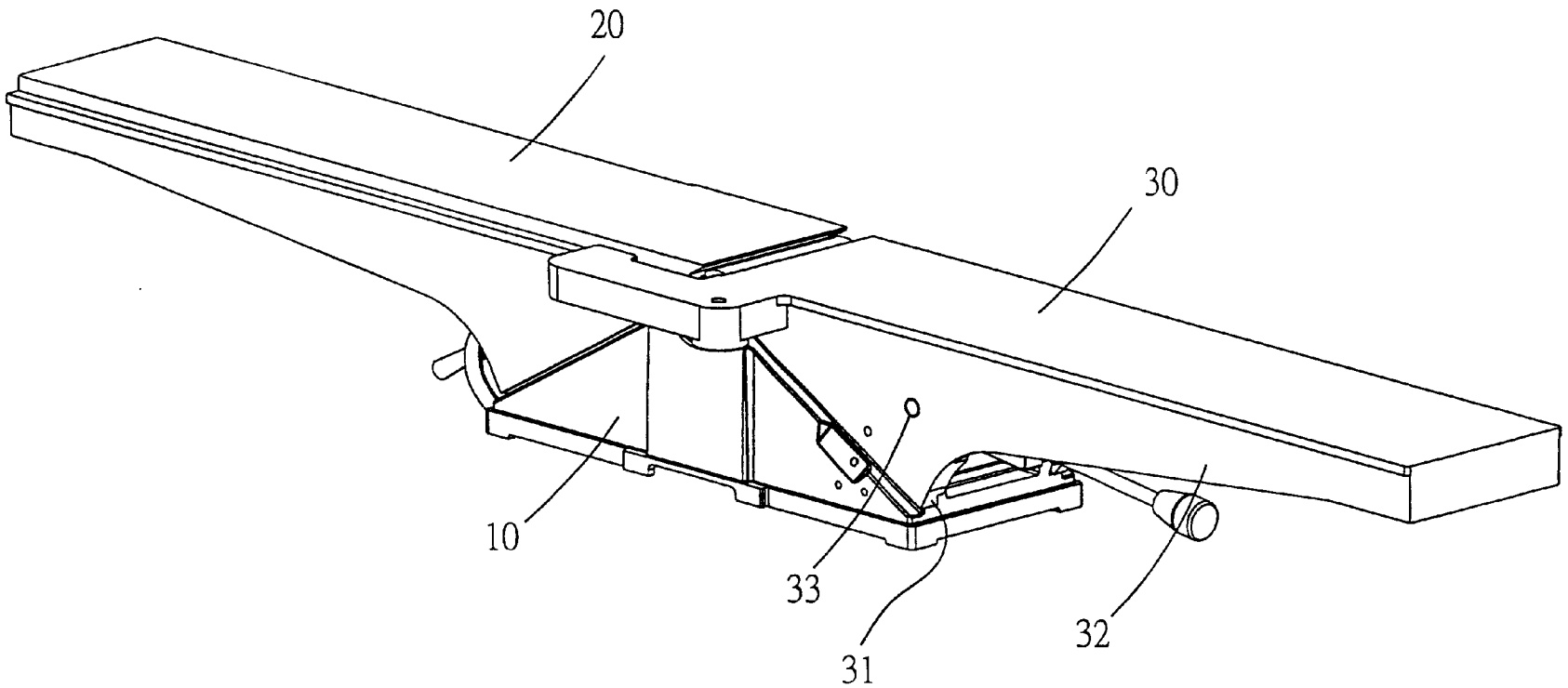
FIG. 2 is a perspective view of a planer provided with a micro-adjusting device for lifting and lowering the worktable of the planer in the present invention.
Figure 3:
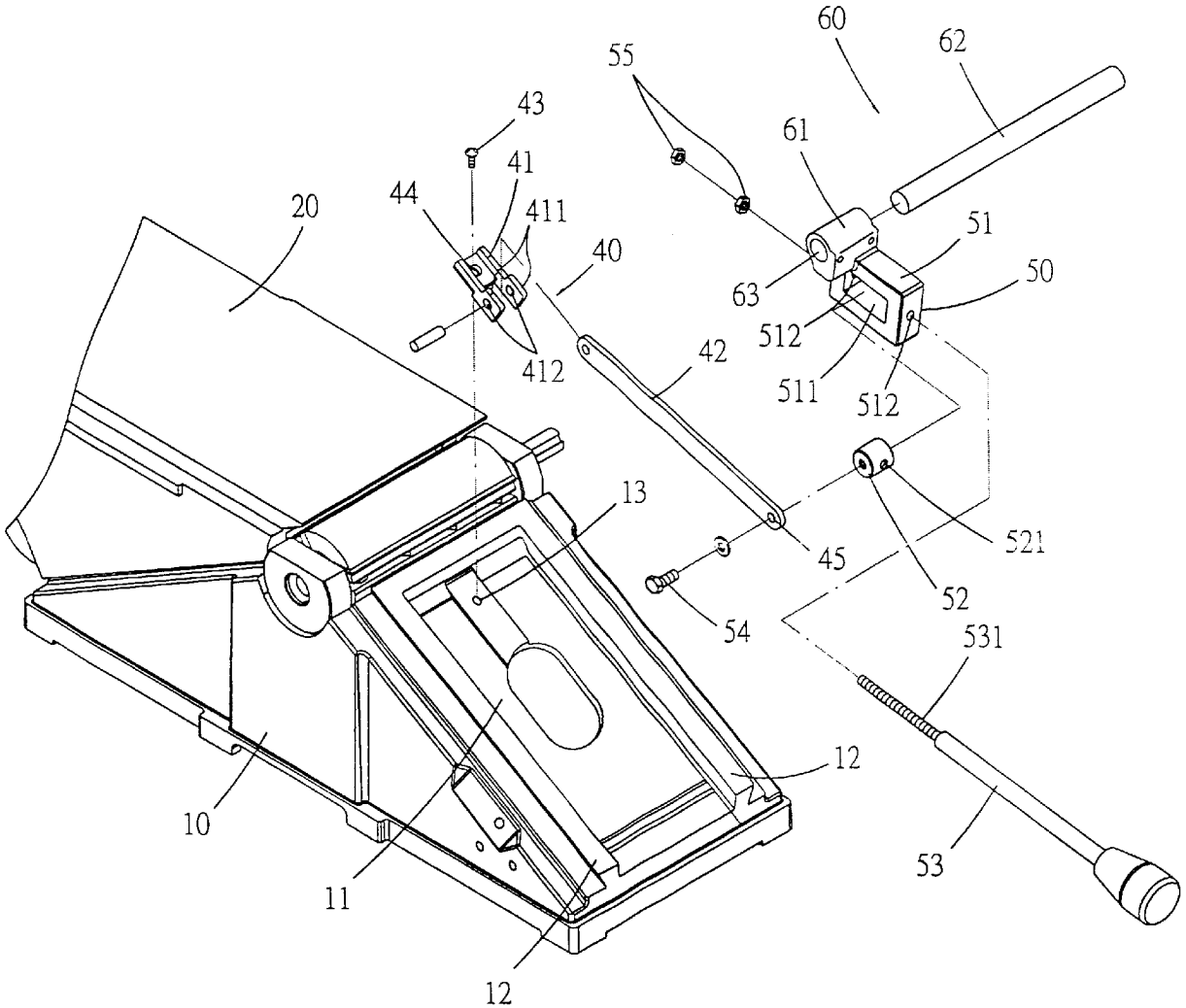
FIG. 3 is an exploded perspective view of the micro-adjusting device for lifting and lowering the worktable of a planer in the present invention.
Figure 4:
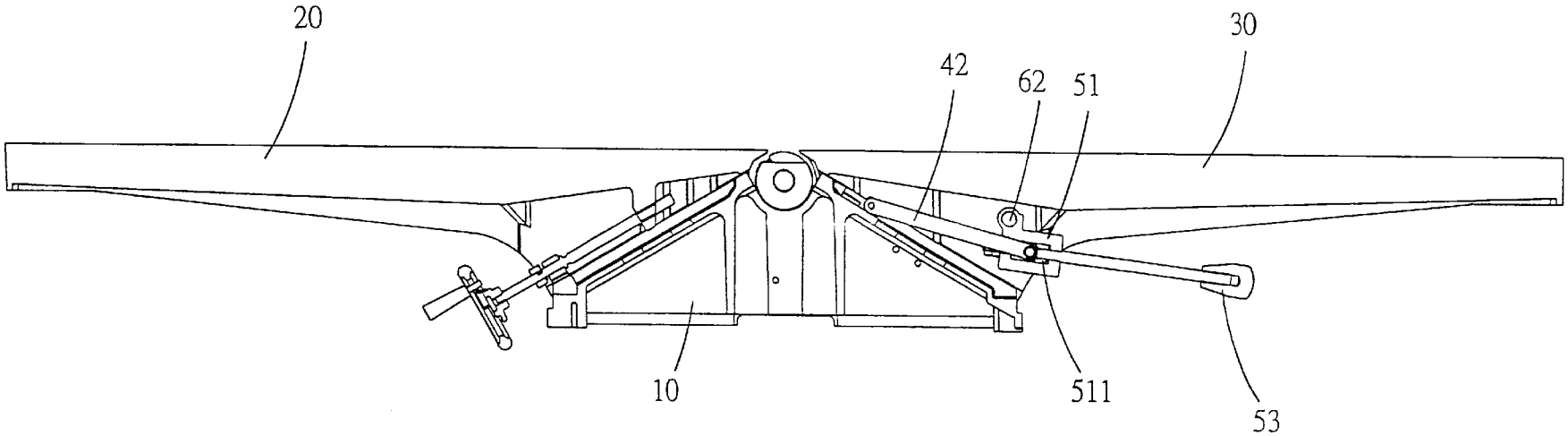
FIG. 4 is a cross-sectional view of the micro-adjusting device for lifting and lowering the worktable of a planer in the present invention.

A preferred embodiment of a micro-adjusting device for lifting and lowering the worktable of a planer in the present invention, as shown in FIGS. 2, 3 and 4, includes a base 10, a stationary worktable 20, a movable worktable 30, a connect rod device 40, an adjusting device 50 and a fix device 60 as main components.

The base 10 has an inclined surface 11 respectively at the right side and the left side, a dove-tail slide plate respective provided at two sides of a front and a rear side of each inclined surface 11. The right side of the base 10 has a threaded hole 13 at a preset point in the right side.

The stationary worktable 20 is fixed on the left side of the base 10.

The movable worktable 30 is located on the right side of the base 10, having a side plate 32 respectively formed downward at two sides and provided with a dove-tail groove 31 at its bottom to fit with the slide plate 12 of the base 10, and a fix hole 33 each bored at a reset point in two side plates 32.

The connect rod device 40 is located at a front end of the inclined surface 11 of the base 10, having a tightening screw 43 passing through a fix hole 44 in a front end of a fix base 41 and then screwing with the threaded hole 13 of the base 10, a side plate 411 each fixed at two sides of the fix base 41 and bored with a pivot hole 412 aligned with each other, and a connect rod 42 pivotally connected to the fix base 41 by passing through the pivot hole 4.12.

The micro-adjusting device 50 consists of an adjusting base 51, an adjusting block 52 and a moving up and down rod 53. The adjusting base 51 has a rectangular hole 511 in the center, and a through hole 512 at the right side of the rectangular hole 511. The adjusting block 52 is contained in the rectangular hole 511, having a through threaded hole 521 extending to the right and the left side. Then the moving up and down rod 53 passes through the through hole 512 of the adjusting base 51, having a front threaded portion 531 to screw with the threaded hole 521 of the adjusting block 52, then protruding out of the through hole 512 at the left side of the adjusting base 51 and screwing with two nuts 55 tightly. Thus, the moving up and down rod 53 can revolve at its position, and utilizing threadably connecting relation of the threaded portion 531 and the adjusting block 52 can force the adjusting block 52 move in the rectangular hole 511. The micro-adjusting device 50 further has a hexagonal screw 54 to engage with the pivotal hole 45 of the connect rod 42 of the connect device 40 and the adjusting block 52.

The fix device 60 has a pivot base 61 formed on an upper side of the adjusting base 51 of the micro-adjusting device 50 and provided with a lateral pivot hole 63 for a fix shaft 62 to pass through, and the two ends of the fix shaft 62 pass through the two fix holes 33 of the movable worktable 30 to enable the same worktable 30 to move up and down on the inclined surface 11 of the base 10 by means of the micro-adjusting device 50.

Figure 5:
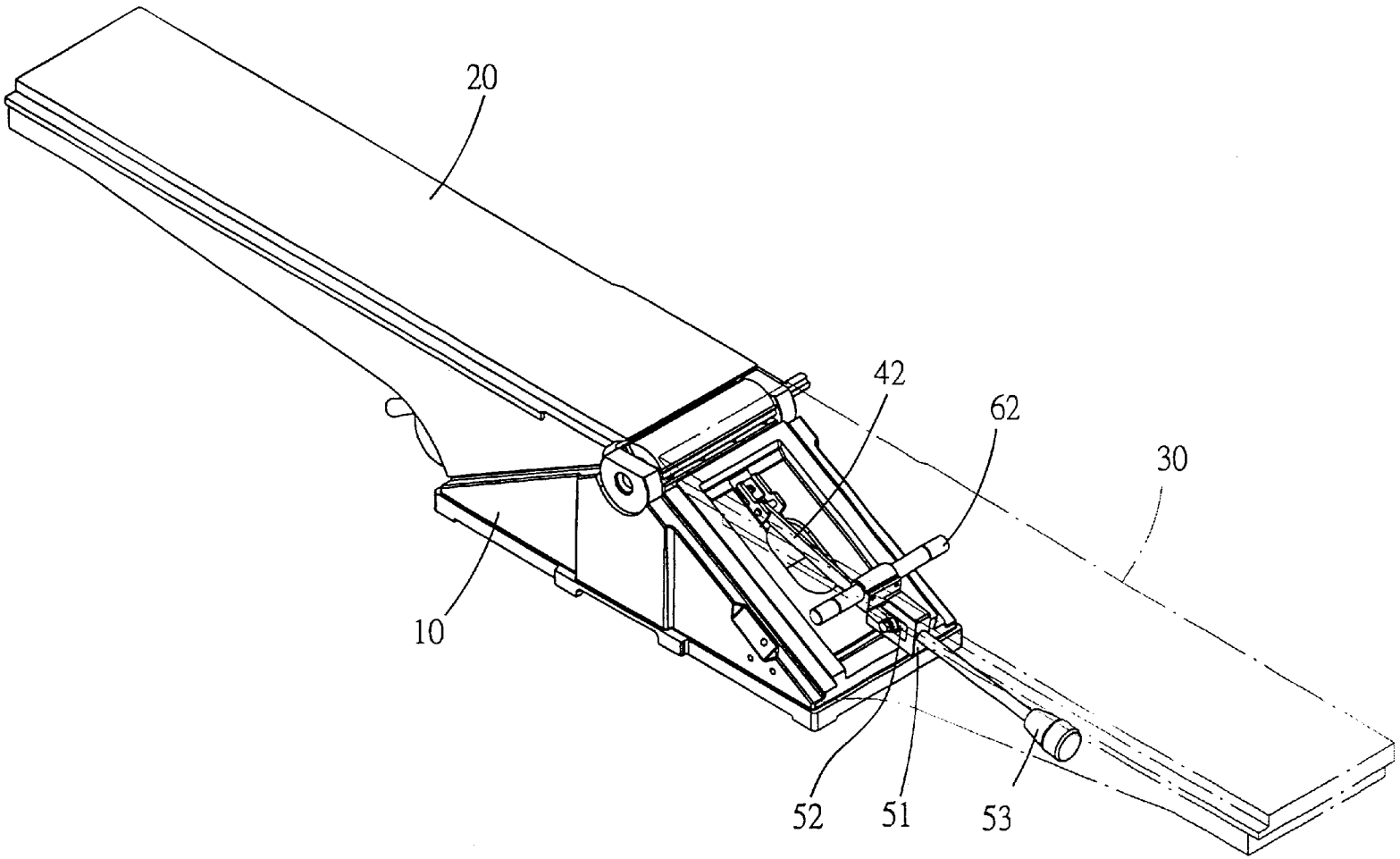
FIG. 5 is a perspective view of the micro-adjusting device for lifting and lowering the worktable of a planer, with the device not yet operated, n the present invention: and, FIG. 6 is a perspective view of the micro-adjusting device for lifting and lowering the worktable of a planer, with the device operated, in the present invention.
Figure 6:
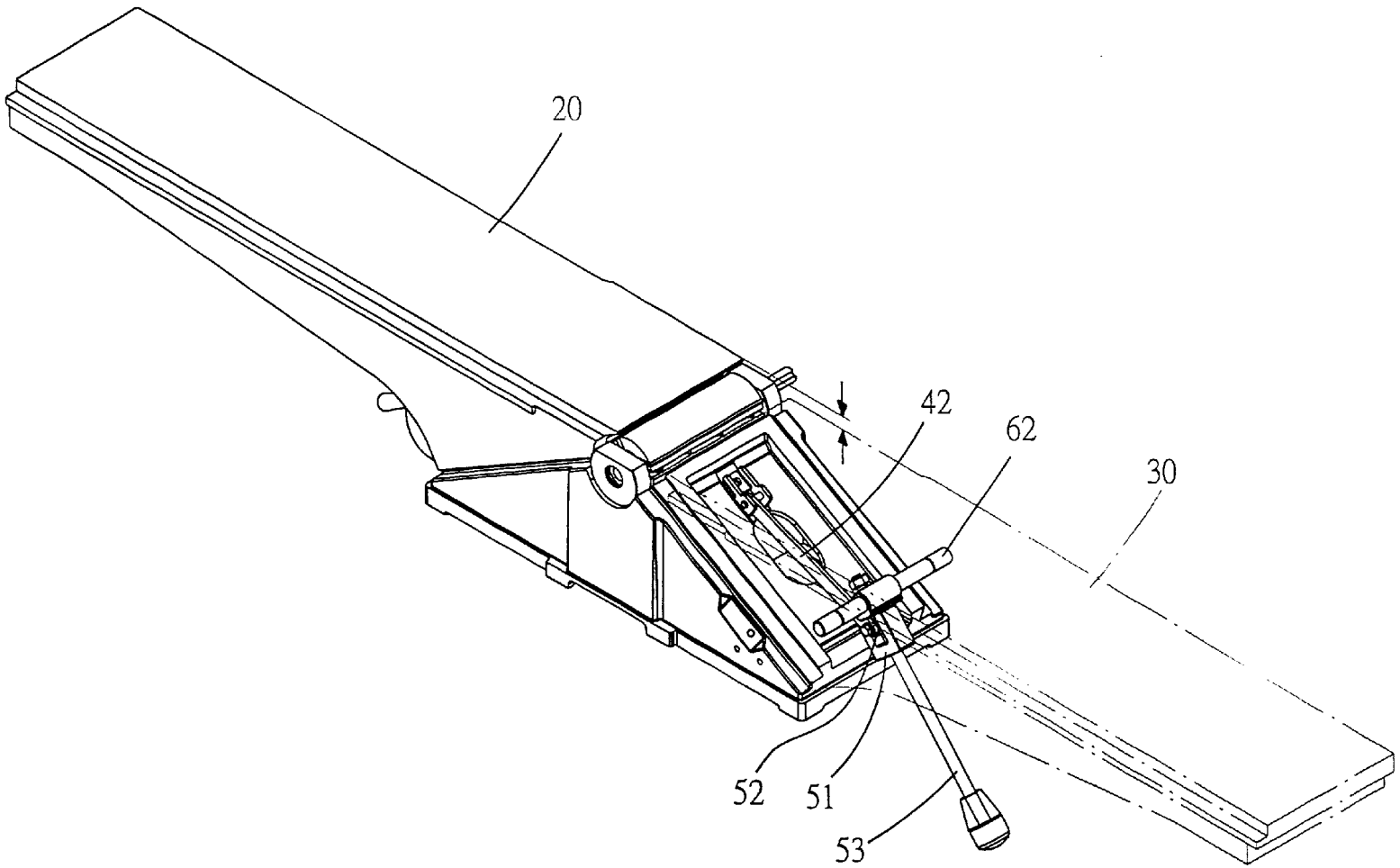

Next, the movement and function of the micro-adjusting device in the invention is to be described. Referring to FIG. 5, in case the movable worktable 30 is to be adjusted in its height, press down the moving up and down rod 53 of the adjusting device 50, then the adjusting device 50 may move down together with the adjusting device 50, as shown in FIG. 6 When a user rotates the moving up and down rod 53, the adjusting block 52 will move in the lengthwise direction of the moving up and down rod 53 because of the moving up and down rod 52 screwing with the adjusting block 52. In addition, the micro-adjusting device 50 is pivotally connected to the movable worktable 30 by means of the fix device 60, so when the adjusting device 50 moves up together with the moving up and down rod 53, the movable worktable 30 also moves up at the same time, effecting the purpose of micro-adjusting.

While the preferred embodiment of the invention has been described above, it will be recognized and understood that various modifications may be made therein and the appended claims are intended to cover all such modifications that may fall within the spirit and scope of the invention.

I claim:

1. A micro-adjusting device for lifting and lowering a worktable of a planer, the planer having a base including a stationary worktable on a first side, and an inclined surface on a second, opposite side, the micro-adjusting device comprising:

a) a movable worktable slidably mounted on the inclined surface of the base;

b) a fix base fixedly mounted on the inclined surface of the base;

c) an adjusting base having a fix shaft connected to the movable worktable, the adjusting base including a through rectangular hole in a center, a through hole passing through opposite sides of the adjusting base;

d) an adjusting block movably located in the rectangular hole in the adjusting base, the adjusting block having a threaded hole extending therethrough;

e) a connect rod pivotally connected to the fix base and to the adjusting block;

f) a movable rod rotatably extending through the through hole of the adjusting base and having a threaded portion engaged with the threaded hole of the adjusting block whereby rotation of the movable rod causes the adjusting block to move within the rectangular hole in the adjusting base, thereby moving the movable worktable along the inclined surface of the base.

2. The micro-adjusting device for lifting and lowering the worktable of a planer as claimed in claim 1, wherein said fix base has a slide plate at two sides, said two side plates having aligned pivot holes, wherein said connect rod is pivotally connected to said fix base through said pivot holes.

3. The micro-adjusting device for lifting and lowering the worktable of a planer as claimed in claim 1, wherein said adjusting base has a pivot base formed on an upper portion, and having a pivot hole; a fix shaft passing through said pivot hole, the fix shaft having two ends passing through two side plates of said movable worktable.

* * * * *